US009117609B2

(12) United States Patent
Kodama

(10) Patent No.: US 9,117,609 B2
(45) Date of Patent: Aug. 25, 2015

(54) ELECTROMAGNETIC OPENING/CLOSING DEVICE

(75) Inventor: Kazuhiro Kodama, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/004,886

(22) PCT Filed: Mar. 7, 2012

(86) PCT No.: PCT/JP2012/055793

§ 371 (c)(1),
(2), (4) Date: Sep. 12, 2013

(87) PCT Pub. No.: WO2012/128040

PCT Pub. Date: Sep. 27, 2012

(65) Prior Publication Data

US 2014/0002945 A1 Jan. 2, 2014

(30) Foreign Application Priority Data

Mar. 22, 2011 (JP) ..... 2011-063236

(51) Int. Cl.

| | |
|---|---|
| ***H01H 9/00*** | (2006.01) |
| ***H01H 47/00*** | (2006.01) |
| ***H01H 51/22*** | (2006.01) |
| ***H01H 1/00*** | (2006.01) |
| *H01H 50/54* | (2006.01) |

(52) U.S. Cl.

CPC ..... *H01H 47/002* (2013.01); *H01H 1/0015* (2013.01); *H01H 50/54* (2013.01)

(58) Field of Classification Search

USPC ..... 361/160

See application file for complete search history.

(56) References Cited

U.S. PATENT DOCUMENTS 7,486,088 B2 * 2/2009 Komatsu et al. ..... 324/700

FOREIGN PATENT DOCUMENTS

| | | | |
|---|---|---|---|
| CN | 101363895 | A | 2/2009 |
| JP | 02-129826 | A | 5/1990 |
| JP | 06-036661 | A | 2/1994 |
| JP | 2009-230921 | A | 10/2009 |

OTHER PUBLICATIONS

Publicatiion No. JP-2001-332160; Relay Apparatus; Fig. 1, Abstract, Specification.*

International Search Report issued in International Application No. PCT/JP2012/055793 with Date of mailing May 15, 2012.

* cited by examiner

*Primary Examiner* — Dharti Patel

(74) *Attorney, Agent, or Firm* — McDermott Will & Emery LLP

(57) ABSTRACT

A contact resistance value detected by a detection means (a resistance detection part) is compared with a predetermined threshold value. A determining means (an abnormality determining part) determines that there is a failure when the contact resistance value exceeds the predetermined threshold value, and then an abnormality detection signal is outputted from an output means (an output part). Therefore, it is possible to detect a failure in a contact, such as oxidization generated on a surface of a contact or contact pressure reduction generated between contacts, based on the contact resistance value of a contact part.

6 Claims, 3 Drawing Sheets

ELECTROMAGNETIC OPENING/CLOSING DEVICE

RELATED APPLICATIONS

This application is the U.S. National Phase under 35 U.S.C. §371 of International Application No. PCT/JP2012/055793, filed on Mar. 7, 2012, which in turn claims the benefit of Japanese Application No. 2011-063236, filed on Mar. 22, 2011, the disclosures of which are incorporated by reference herein.

TECHNICAL FIELD

The invention relates to an electromagnetic opening/closing device, such as an electromagnetic relay.

BACKGROUND ART

Conventionally, there is an electromagnetic opening/closing device, which is disclosed in Japanese Patent Application Publication No. 2009-230921 for example. In the electromagnetic opening/closing device described in the document, a relay unit (electromagnetic relay) is housed within a casing made of synthetic resin, and a pair of main terminals and a pair of coil terminals are located so as to project at the casing. In this case, the pair of main terminals is connected to a contact of the relay unit, and a pair of coil terminals is connected to a coil used for an electromagnet of the relay unit. Further, the pair of main terminals is connected to a power-feeding path through which the electric power is supplied from an electric power source to a load. While excitation current flows between the pair of coil terminals, the relay unit (electromagnetic opening/closing device) turns on. While the excitation current does not flow between the pair of coil terminals, the relay unit (electromagnetic opening/closing device) turns off. That is, the power-feeding path from the electric power source to the load is closed, when the electromagnetic opening/closing device turns on, and is opened, when the electromagnetic opening/closing device turns off.

Here, in the electromagnetic opening/closing device as explained above, a surface of the contact (including a fixed contact and a movable contact) may be oxidized, or a spring force of a contact pressure spring may be reduced, due to deterioration with time, use frequency (the number of times of opening/closing) or the like.

DISCLOSURE OF THE INVENTION

It is an object of the present invention to provide an electromagnetic opening/closing device, which can detect a failure in a contact, such as oxidization generated on a surface of a contact or contact pressure reduction generated between contacts.

An electromagnetic opening/closing device of the present invention comprises: a contact part having a fixed contact, and a movable contact that comes into contact with/separates from the fixed contact; a displacement means configured to make the movable contact come into contact with/separate from the fixed contact by displacing the movable contact; a detection means configured to detect contact resistance at the contact part; a determining means configured to compare a value relevant to the contact resistance detected by the detection means with a predetermined threshold value, and to determine that there is a failure when the value relevant to the contact resistance exceeds the predetermined threshold value; and an output means configured to output the determined result of the determining means.

In this configuration, the electromagnetic opening/closing device provides an effect of being capable of detecting a failure in a contact, such as oxidization generated on a surface of a contact or contact pressure reduction generated between contacts.

In the electromagnetic opening/closing device, preferably, the contact part comprises, as the fixed contact, two fixed contacts inserted in an electric path, and wherein the detection means comprises: a voltage detection part detecting a potential difference between the two fixed contacts; and a current detection part detecting a current flowing through the electric path, the detection means being configured to calculate, as the value relevant to the contact resistance, a contact resistance value, based on the potential difference between the two fixed contacts detected by the voltage detection part and a value of the current detected by the current detection part.

Preferably, the electromagnetic opening/closing device further comprises a storage means storing the value relevant to the contact resistance detected by the detection means, wherein the determining means is configured to determine a failure in the contact part based on a history of values relevant to the contact resistance stored in the storage means.

In the electromagnetic opening/closing device, preferably, the determining means is configured to determine the failure in the contact part based on a history of average values of the values relevant to the contact resistance stored in the storage means.

In the electromagnetic opening/closing device, preferably, the predetermined threshold value is set to be divided into two types, an abnormal value for determining the failure in the contact part and a warning value less than the abnormal value, and wherein even when, in the history, the values relevant to the contact resistance exceed the warning value continuously a prescribed number of times or more, the determining means is configured to determine the failure in the contact part.

An electromagnetic opening/closing device of the present invention comprises: a contact part having a fixed contact, and a movable contact that comes into contact with/separates from the fixed contact; a displacement means configured to make the movable contact come into contact with/separate from the fixed contact by displacing the movable contact; a detection means configured to detect contact resistance at the contact part; a storage means storing a value relevant to the contact resistance detected by the detection means; a determining means configured to determine a failure in the contact part based on a history of values relevant to the contact resistance stored in the storage means; and an output means configured to output the determined result of the determining means.

In this configuration, the electromagnetic opening/closing device provides an effect of being capable of detecting a failure in a contact, such as oxidization generated on a surface of a contact or contact pressure reduction generated between contacts.

In the electromagnetic opening/closing device, preferably, the determining means is configured to determine the failure in the contact part based on a history of average values of the values relevant to the contact resistance stored in the storage means.

BRIEF DESCRIPTION OF THE DRAWINGS

Preferred embodiments of the invention will now be described in further details. Other features and advantages of the present invention will become better understood with regard to the following detailed description and accompanying drawings where.

BEST MODE FOR CARRYING OUT THE INVENTION

Figure 1A:
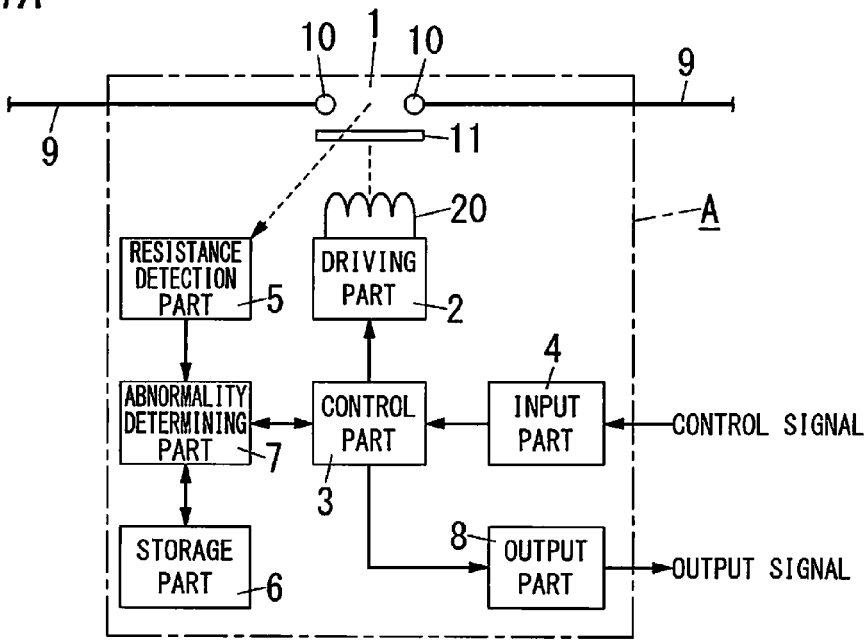
FIG. 1A is a block diagram illustrating an electromagnetic opening/closing device according to an embodiment of the present invention.

As shown in FIG. 1A, an electromagnetic opening/closing device A according to the present embodiment includes a contact part 1, a driving part 2, a control part 3, an input part 4, a resistance detection part 5, a storage part 6, an abnormality determining part 7, an output part 8 and the like. The contact part 1 has two fixed contacts 10 that are inserted in an electric path 9, and a movable contact (mover) 11 that comes into contact with/separates from the two fixed contacts 10. That is, while the movable contact 11 comes into contact with the two fixed contacts 10, the contact part 1 is closed and the electric path 9 is in a conducting state. On the other hand, while the movable contact 11 does not come into contact with the two fixed contacts 10, the contact part 1 is opened and the electric path 9 is in a non-conducting state.

The driving part 2 is a displacement means that makes the movable contact 11 come into contact with/separate from the two fixed contacts 10 by displacing the movable contact 11. The driving part 2 displaces the movable contact 11 through an electromagnetic force generated by making excitation current flow to an excitation coil 20. The control part 3 controls the driving part 2 in response to a control signal inputted from outside into the input part 4. That is, when the control signal for a contact ON is inputted into the input part 4, the control part 3 controls the driving part 2 to close the contact part 1. On the other hand, when the control signal for a contact OFF is inputted into the input part 4, the control part 3 controls the driving part 2 to open the contact part 1.

Figure 1B:
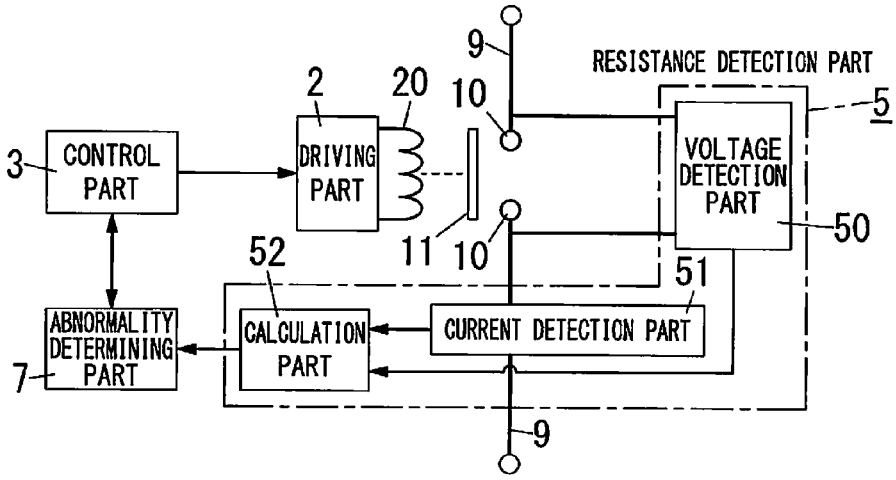
FIG. 1B is a block diagram illustrating a resistance detection part in the electromagnetic opening/closing device according to the embodiment of the present invention.

As shown in FIG. 1B, the resistance detection part 5 includes: a voltage detection part 50 that detects a potential difference between the two fixed contacts 10 (a voltage between contacts); a current detection part 51 that detects a current flowing through the electric path 9; and a calculation part 52 that calculates, as a value relevant to contact resistance, a contact resistance value of the contact part 1, based on the voltage between contacts detected by the voltage detection part 50 and a value of the current detected by the current detection part 51.

The abnormality determining part 7 compares the contact resistance value calculated by the calculation part 52 with a predetermined threshold value stored in the storage part 6, and then determines that there is no failure in the contact part 1, when the contact resistance value is less than the predetermined threshold value. On the other hand, the abnormality determining part 7 determines that there is a failure in the contact part 1 when the contact resistance value is equal to or more than the predetermined threshold value, and then outputs the determined result into the control part 3. The control part 3 allows the output part 8 to output an abnormality detection signal, when receiving the determined result that there is the failure from the abnormality determining part 7. Here, for example, the functions provided in the control part 3, calculation part 52, storage part 6 and abnormality determining part 7 can be implemented by allowing a microcomputer to execute programs respectively corresponding to the functions.

Figure 2:
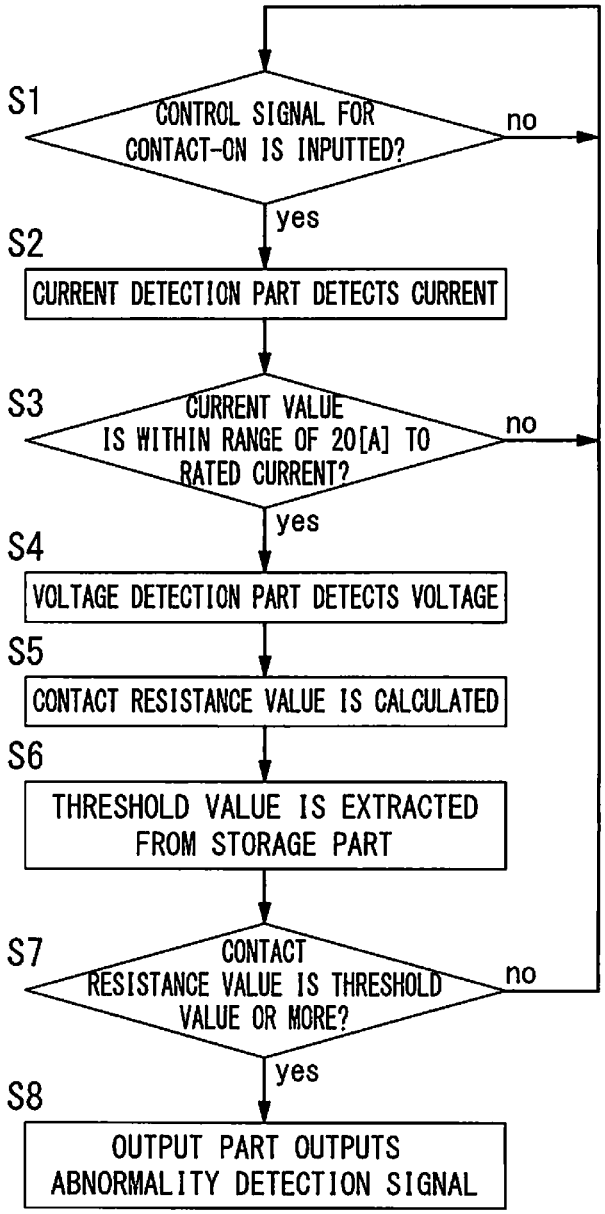
FIG. 2 is a flow chart for explaining operation of the electromagnetic opening/closing device according to the embodiment of the present invention.

Operation according to the present embodiment will be explained in detail, referring to a flow chart shown in FIG. 2.

When the control signal for the contact ON is inputted into the input part 4 (Step S1), the control part 3 controls the driving part 2 to close the contact part 1 and then makes the current detection part 51 of the resistance detection part 5 detect the current (Step S2). The control part 3 determines whether or not a value of the current detected by the current detection part 51 is within a range of 20 [A] to a rated current (Step S3). Then, if the value of the current is within the range of 20 [A] to the rated current, the control part 3 makes the voltage detection part 50 of the resistance detection part 5 detect the voltage between contacts (Step S4). If the value of the current is out of the range of 20 [A] to the rated current, the processing of the control part 3 is returned to the Step S1, and the control part 3 awaits input of the next control signal for the contact ON.

Here, if a load connected to the electric path 9 is a resistance load, the phase of the voltage between contacts becomes the same as that of a load current (a current flowing through the contact part 1), and therefore it is possible to obtain the contact resistance value by dividing the voltage between contacts by a value of the load current. However, if the load connected to the electric path 9 is a capacitive load or an induced load, a phase difference occurs between the voltage between contacts and the load current, and therefore, a value more than the actual contact resistance value or a value less than the actual contact resistance value may be calculated depending on a timing when the voltage between contacts and the load current are detected. Therefore, in the present embodiment, in order to calculate the contact resistance value more correctly, when a current with a certain magnitude flows through the contact part 1, the detection of the current is performed. In the present embodiment, the range of 20 [A] to the rated current for the value of the current is one example, and is not limited to such a value.

The calculation part 52 of the resistance detection part 5 calculates the contact resistance value of the contact part 1 by dividing the voltage between contacts detected by the voltage detection part 50 by the value of the current detected by the current detection part 51 (Step S5). The calculated contact resistance value is transferred from the resistance detection part 5 to the abnormality determining part 7. Then, the abnormality determining part 7 extracts the predetermined threshold value from the storage part 6 (Step S6), and compares the contact resistance value with the predetermined threshold value (Step S7). If the contact resistance value is less than the predetermined threshold value, the abnormality determining part 7 determines that there is no failure in the contact part 1, and the processing is returned to the Step S1. On the other hand, if the contact resistance value is equal to or more than the predetermined threshold value, the abnormality determining part 7 determines that there is a failure in the contact part 1, and then outputs the determined result into the control part 3. The control part 3 allows the output part 8 to output an abnormality detection signal, when receiving, from the abnormality determining part 7, the determined result that there is the failure (Step S8).

As above, the determining means (abnormality determining part 7) compares the contact resistance value detected by the detection means (resistance detection part 5) with the predetermined threshold value, and determines that there is a failure when the contact resistance value exceeds the predetermined threshold value, and the abnormality detection signal is outputted from the output means (output part 8). That is, according to the present embodiment, it is possible to detect a failure in a contact, such as oxidization generated on a surface of a contact or contact pressure reduction generated between contacts, based on the contact resistance value of the contact part 1. Here, the abnormality detection signal outputted from the output part 8 is inputted into, for example, an external device that outputs a control signal. In this case, the external device emits a warning or the like, and then replacing or repairing is performed.

Figure 3:
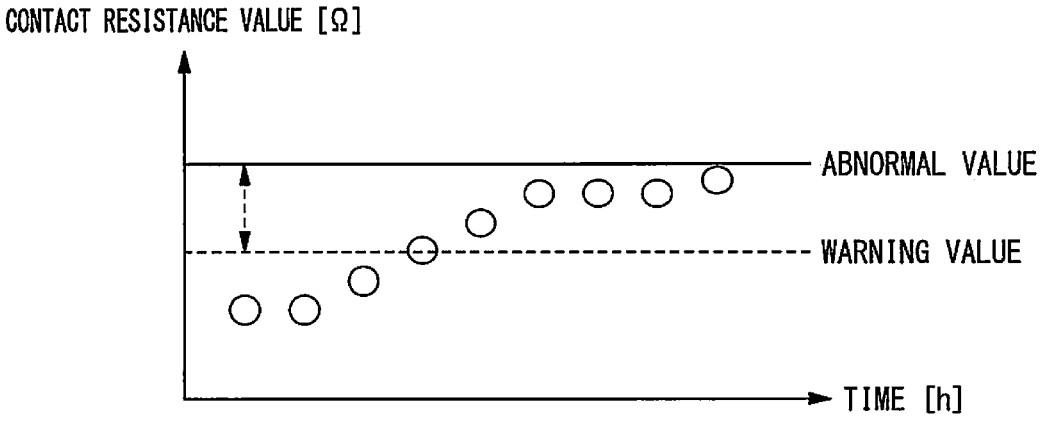
FIG. 3 is a diagram for explaining operation of the electromagnetic opening/closing device according to the embodiment of the present invention.

Here, if a foreign matter (an insulator) jams between the fixed contacts 10 and the movable contact 11, it is considered that the contact resistance value increases rapidly. On the other hand, if an oxide film is generated on a surface of a contact or a contact pressure is reduced, it is considered that the contact resistance value increases gradually. Therefore, it is preferred that the predetermined threshold value, with which the contact resistance value detected by the resistance detection part 5 is compared, is set to be divided into two types, an abnormal value for determining the failure in the contact part 1 and a warning value less than the abnormal value, and then even when contact resistance values exceed the warning value continuously five times or more, the abnormality detection signal is outputted (see FIG. 3). The number of times used for determining the failure is not limited to five times. That is, a storage means (the storage part 6) stores a history of contact resistance values detected by the detection means (the resistance detection part 5), and the determining means (the abnormality determining part 7) determines the failure in the contact part 1, based on the history of the contact resistance values stored in the storage part 6 (the storage means).

Here, in consideration of the fluctuation of the load current, if the calculation part 52 calculates a contact resistance value for each constant period counted by a timer (not shown), and compares an average value of a plurality of contact resistance values, obtained by multiple calculations, with the predetermined threshold value (or, the abnormal value and the warning value), it is possible to detect the failure in the contact part 1 more accurately.

As a method in which the resistance detection part 5 detects contact resistance, the temperature of the contact part 1 may be detected. That is, the temperature of the contact part 1 increases in proportion to the contact resistance. Therefore, if a temperature sensor is installed at a connecting part of the fixed contact 10 and the electric path 9, it is possible to determine the failure in the contact part 1 through comparing the temperature detected by the temperature sensor, instead of the contact resistance value, with the predetermined threshold value.

Although the present invention has been described with reference to certain preferred embodiments, numerous modifications and variations can be made by those skilled in the art without departing from the true spirit and scope of this invention, namely claims.

The invention claimed is:

1. An electromagnetic opening/closing device, comprising:

a contact part having a fixed contact, and a movable contact that comes into contact with/separates from the fixed contact;

a displacement means configured to make the movable contact come into contact with/separate from the fixed contact by displacing the movable contact;

a detection means configured to detect contact resistance at the contact part;

a determining means configured to compare a value relevant to the contact resistance detected by the detection means with a predetermined threshold value, and to determine that there is a failure when the value relevant to the contact resistance exceeds the predetermined threshold value; and an output means configured to output the determined result of the determining means, wherein the contact part comprising, as the fixed contact, two fixed contacts inserted in an electric path, and wherein the detection means comprises:

a voltage detection part detecting a potential difference between the two fixed contacts; and a current detection part detecting a current flowing through the electric path, the detection means being configured to calculate, as the value relevant to the contact resistance, a contact resistance value, based on the potential difference between the two fixed contacts detected by the voltage detection part and a value of the current detected by the current detection part.

2. The electromagnetic opening/closing device according to claim 1, further comprising a storage means storing the value relevant to the contact resistance detected by the detection means, wherein the determining means is configured to determine a failure in the contact part based on a history of values relevant to the contact resistance stored in the storage means.

3. The electromagnetic opening/closing device according to claim 2, wherein the determining means is configured to determine the failure in the contact part based on a history of average values of the values relevant to the contact resistance stored in the storage means.

4. The electromagnetic opening/closing device according to claim 2, wherein the predetermined threshold value is set to be divided into two types, an abnormal value for determining the failure in the contact part and a warning value less than the abnormal value, and wherein even when, in the history, the values relevant to the contact resistance exceed the warning value continuously a prescribed number of times or more, the determining means is configured to determine the failure in the contact part.

5. An electromagnetic opening/closing device, comprising:

a contact part having a fixed contact, and a movable contact that comes into contact with/separates from the fixed contact;

a displacement means configured to make the movable contact come into contact with/separate from the fixed contact by displacing the movable contact;

a detection means configured to detect contact resistance at the contact part;

a storage means storing a value relevant to the contact resistance detected by the detection means;

a determining means configured to determine a failure in the contact part based on a history of values relevant to the contact resistance stored in the storage means; and an output means configured to output the determined result of the determining means.

6. The electromagnetic opening/closing device according to claim 5, wherein the determining means is configured to determine the failure in the contact part based on a history of average values of the values relevant to the contact resistance stored in the storage means.

* * * * *